United States Patent [19]

Wonisch

[11] 4,190,034

[45] Feb. 26, 1980

[54] APPARATUS FOR STARTING AND FANNING A FIRE

[75] Inventor: Franz Wonisch, Arnsberg, Fed. Rep. of Germany

[73] Assignee: Mayer & Wonisch Spezialfabrik fuer Mess- und Regelgeraete, Arnsberg, Fed. Rep. of Germany

[21] Appl. No.: 875,859

[22] Filed: Feb. 7, 1978

[30] Foreign Application Priority Data

Feb. 17, 1977 [DE] Fed. Rep. of Germany ..... 2706762

[51] Int. Cl.[2] ..... F24B 3/00; F23Q 7/12

[52] U.S. Cl. ..... 126/25 B; 431/72; 431/255

[58] Field of Search ..... 431/72, 255; 126/25 B

[56] References Cited

U.S. PATENT DOCUMENTS

| | | | |
|---|---|---|---|
| 1,295,907 | 3/1919 | Le Compte | 126/25 B |
| 2,192,732 | 3/1940 | Johnson | 126/25 B |
| 2,666,480 | 1/1954 | Peterson | 431/255 |
| 3,406,001 | 10/1968 | Ishibashi | 431/255 |
| 3,436,164 | 4/1969 | Devcher | 431/255 |
| 3,576,471 | 4/1971 | Schumacher | 431/255 |
| 3,622,258 | 11/1971 | Goto | 431/255 |
| 3,792,958 | 2/1974 | Siegfreid | 431/255 |

FOREIGN PATENT DOCUMENTS

| | | | |
|---|---|---|---|
| 1488614 | 7/1967 | Fed. Rep. of Germany | 431/255 |

*Primary Examiner*—James C. Yeung
*Assistant Examiner*—Daniel J. O'Connor
*Attorney, Agent, or Firm*—W. G. Fasse; F. D. Gould

[57] ABSTRACT

The present apparatus for starting and fanning a fire, for example in a fireplace, is hand operated and combines in a common handle housing a source of fuel for providing an ignition flame and a power source as well as a fan for blowing air into the fire. The fan is driven by the power source such as a battery. The control for the apparatus is so arranged that the supply of fuel gas and an ignition spark occur substantially simultaneously, whereby the fan is preferably operating on "low". Once the fire has started the fuel gas supply is stopped and the fan may be operated on "high" by an electric motor which may be driven by said battery or through an adapter from a power outlet.

14 Claims, 1 Drawing Figure

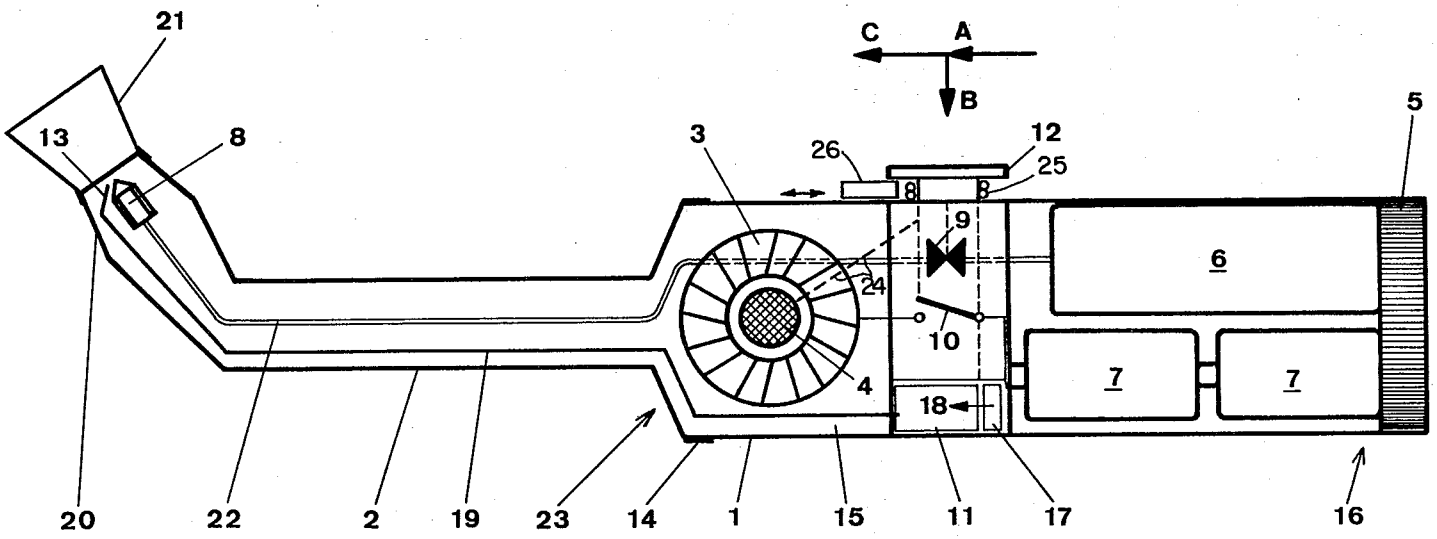
5
16
6
7
7
17
12
25
A
B
C
9
10
18
11
8
24
4
15
26
3
1
14
23
19
2
22
8
21
13
20

APPARATUS FOR STARTING AND FANNING A FIRE

BACKGROUND OF THE INVENTION

The present invention relates to an apparatus for starting and fanning a fire, in the form of a hand held device for igniting a charcoal grill or a fireplace or the like. Any other type of heating system could also be started with the present apparatus, for example, an oil heater.

It is known for the above purpose to employ a liquid gas burner combined with an electrical glow wire ignition. Such an apparatus is disclosed in German Utility Model 1,885,990. It is also known to operate a fan by means of batteries, however, without any ignition means as disclosed in German Utility Model 7,144,546.

The two devices of the prior art are thus limited in their usefulness because the one is only capable of igniting the available fuel in a limited area whereas the other device is merely capable of supplying combustion air toward a fuel supply which has already been ignited by other means. Thus, heretofore it was necessary to use two separate devices for achieving a rapid and proper starting of heating sources as enumerated above. First one has to use the ignitor and then the fan. Buying two of these devices is expensive and using them is time consuming.

OBJECTS OF THE INVENTION

In view of the above it is the aim of the invention to achieve the following objects singly or in combination:

to provide a control for such a device which will make the device simple to operate and substantially safe in its function as well as foolproof;

to make sure that the ignition spark is available substantially simultaneously at the exit nozzle of the starting gas fuel as the latter is supplied to said nozzle;

to provide a control mechanism for an ignition apparatus as disclosed herein which will automatically return in the closing position when the handle is released or when the apparatus is put aside so that the ignition gas will always be stopped when the apparatus is not used or when the fan is operated on "high"; and to provide a fuel ignition apparatus which may, on the one hand, be a self contained unit or which may receive its fuel supply as well as its power supply from external sources by the use of respective adapters to be inserted into the apparatus.

SUMMARY OF THE INVENTION

According to the invention there is provided an apparatus for starting and fanning a fire which is characterized in that inside a housing that is preferably shaped as a handle and which is provided with a pipe section, there is arranged a liquid gas burner and piezo-electric means for igniting the liquid gas as it emerges from the burner. A battery operated fan is also located in the housing along with the power source for the fan. The operating mechanism for the fan, the piezo-electric means, and for the supply of the ignition gas is arranged in such a manner that the ignition proper as well as the supply of the ignition gas and of the combustion air are coordinated to each other in function and operation sequence.

In this manner it is achieved that the ignition gas is instantaneously ignited as it emerges from the nozzle opening which is preferably located at the open tip of said pipe section since a spark gap is formed between the nozzle proper and a conductor extending from said spark gap to the piezo-electric means.

In the first phase of operation the blower is operated on low to provide just sufficient air for igniting the respective fuel, for example, in a fireplace or the like. Thus, the calorific output of the ignition gas flame is advantageously supported or enhanced by the air being supplied in a gentle, low manner by the fan. Thus, an over supply of air is avoided in the initial starting phase. Such over supply would merely blow out the ignition flame. Just as soon as sufficient fuel has started in the heating device to be ignited, the fan may be switched to high by the same control element. In this second operational position the ignition gas supply is interrupted and the fan supplies the maximum of fanning air, whereby the fuel in the fireplace may be uniformly and quickly ignited.

BRIEF FIGURE DESCRIPTION

In order that the invention may be clearly understood, it will now be described, by way of example, with reference to the accompanying drawing, wherein the single FIGURE illustrates a sectional view through an apparatus according to the invention, whereby the section extends along the longitudinal axis of the apparatus.

DETAILED DESCRIPTION OF PREFERRED EXAMPLE EMBODIMENTS

The present apparatus comprises a housing 1 which may be made of plastics material or sheet metal in any conventional way. The housing 1 is hollow and comprises a number of cavities. A pipe section 2 is secured to the front end 23 of the housing 1, for example, by a threaded section 14. A radial blower or fan 3 is located in a cavity 15 of the housing 1. Lateral openings 4, for example, covered with wire mesh or the like provide air access for the radial blower fan 3. The fan is driven by a motor not shown.

The rear end 16 of the housing 1 is closed by a conventional screw cap 5. A liquid gas cartridge 6 is located in a further cavity in the housing 1 accessible through the screw cap 5. Dry cell batteries 7 are located in series connection in yet another cavity also accessible through the screw cap 5. Thus, the fuel gas cartridge 6 as well as the batteries 7 are easily exchangeable or replaceable.

Intermediate between the radial blower 3 and the supply components 6, 7 there is arranged a piezo-electric element 11 connected through a conductor 19 to a spark gap member 13. The spark gap is formed by the member 13 and the fuel gas nozzle 8 located in the tip 20 of the pipe section 2. A baffle or guide member 21 may be secured to the tip 20 of the pipe section 2 for guiding the flame emanating from the nozzle 8 which is connected through a conduit 22 and a valve 9 to the fuel gas cartridge 6.

Further, intermediate the blower 3 and the supply components 6, 7 there is arranged a switch 10 and the above mentioned valve, all of which are operable through the control member 12 in the form of a button outside the housing 1. The switch 10 may be a multi-position switch for operating the blower 3 at least in a low and high fashion. The piezo-electric crystal 11 is so located that an activating force indicated by the arrow 18 may be exerted on the crystal 11 through a mechanical member 17 also operatively connected to the button 12.

The mechanical connection between the button 12 and the valve 9, the button 12 and the switch 10, and the member 17 and the button 12 are indicated by dashed lines. The arrows A, B, and C indicated above the button 12 explain the function of this button. Thus, the pushing of the button 12 in the direction of the arrow A or horizontally halfway from a rest position to a fully operated position, opens the valve 9 and energizes the blower fan 3 in a low type of operation. When the button 12 is then pushed down in the direction of the arrow B, the member 17 exerts a force 18 on the piezo-electric crystal 11, whereby a spark is produced across the spark gap between the nozzle 8 and the spark gap member 13, whereby the gas emanating from the nozzle 8 is ignited. Thereafter the button 12 is pushed forward in the direction of the arrow C to operate the fan 3 at a high type of operation to supply the maximum blower air to the fuel being ignited, for example, in a fireplace. In the position C the valve 9 is closed so that no further ignition fuel gas is supplied to the nozzle 8. The control of the blower 3 may, for example, be accomplished by changing the r.p.m. of the electric drive motor for the blower 3 or by varying the surface area of the air intake opening 4. Such surface area variation may be accomplished mechanically, for example, also through the button 12 by combining the movement of a closure member for the opening 4 with the movement of the button 12 as indicated by dashed line 24.

The tip 20 of the pipe section 2 which holds the spark gap member 13 and the nozzle 8 is preferably bent in a direction corresponding to the direction in which the button 12 is located on the housing 1. This arrangement has the advantage that, for example, in a fireplace the present apparatus may conveniently be held with its nozzle tip 20 under a pile of wood in the fireplace so that the ignition flame and the blowing air may rise upwardly into the flue. The fuel gas supply line 22 and the electrical conductor 9 are properly supported in the pipe section 2 and lead respectively to the gas closure valve 9 and to the piezo-electric crystal 11. The tip 20 of the pipe 2 is shaped so as to protect and hold the burner nozzle 8 as well as the ignition spark member 13. Further, the protective front end 21 which is preferably funnel shaped may be somewhat flattened to prevent the entry of extraneous elements such as ash or charcoal particles into the tip 20 of the pipe 2.

As mentioned above the shown bend of the tip 20 relative to the longitudinal extension of the pipe section 2 facilitates the ignition of a fireplace because the bend will cause the flame to reach upwardly. The bend also facilitates the starting of a charcoal grill when the tip 20 is pointed downwardly onto the charcoal.

It has been found that by the arrangement of the liquid gas cartridge 6 so that in the operational position its longitudinal axis is substantially horizontal whereas in the nonused position its longitudinal axis is substantially vertical, the advantage is accomplished that in the vertical position only the gas still in the pipeline 22 will reach the nozzle 8 for combustion, whereas in the substantially horizontal position the gas will be prevented from reaching the nozzle 8 unless the button 12 is operated to open the valve 9. Furthermore, as the liquid gas flows through the pipeline 22 it will be vaporized. Thus, it is advantageous to make the pipeline 22 of copper piping for improving a preheating of the liquid gas and thus its vaporization prior to reaching the nozzle 8. Hence, the present apparatus has the advantage that only in the position in which it is used, namely, in the substantially horizontal position there will be a full ignition gas supply whereas in the non-used, vertical position, the gas supply is interrupted. This is a safety advantage of the invention.

The housing 1, is preferably cylindrical, however, a square or rectangular shape may also be suitable.

The above described control elements 9, 10, and 12 are arranged in such a manner that the ignition flame may be completely interrupted and only combustion air is supplied to the blower 3. In an alternative embodiment the ignition flame may be guided in such a manner, for example, by a baffle, not shown, but located in the tip 20 of the pipe 2 so that the ignition flame heats the air which is supplied to enhance the combustion of the fuel in a fireplace or grill. In such an embodiment the shape of the nozzle 8 would be such as to produce a broader flame rather than a pointed flame. Also, the nozzle 8 would be located somewhat more recessed in the tip 20 of the pipe 2 so that the air from the blower 3 could flow all around the nozzle 8 for an intensive mixing of the flame with the air supplied with the blower 3. To enhance this preheating of the combustion air a baffle plate or plates may be located inside the pipe section 2 or rather in its tip, whereby these baffle plates could also prevent the flame from penetrating outside of the tip proper. The baffle plates should be located so as to prevent any formation of eddy currents. With the just described modification employing baffle plates for guiding the air so as to intensively intermix with the flame, the apparatus is especially suitable for the ice removal from the windshield of a car or truck. For this purpose the flattened outlet member 21 could be provided with a sliding edge of rubber or synthetic material so as to protect the glass of the windshield.

Incidentally, the air inlet port 4 is arranged so as to extend substantially at right angles of the axis of the blower fan 3. As mentioned, the size of the area constituting the opening 4 may be arranged to be variable by any conventional means. For example, a slide plate movable in two tracks could be pushed back and forth across the opening 4 in response to the actuation of the button 12. Thus, the air supplied to the tip 20 could be controlled in its quantity.

It has been found to be advantageous to arrange the above described control elements intermediate between the blower 3 and the supply components 6, 7. Preferably, the button 12 actuates a combined pressure shifting switch for the actuation of the valve 9, the contact 10, and the piezo-electric crystal 11. However, separate actuation elements could also be used and it would be preferable to locate them for convenient actuation with one hand. For safety purposes the valve 9 could be of the type that closes automatically, for example, in response to the action of a spring 25 when the respective button 12 is released. Thus, any further ignition fuel gas from the cartridge 6 would be interrupted when the button is not depressed or shifted.

The just described feature for automatically closing the valve 9 when the button 12 is released remains effective until the button 12 is actuated again. In addition the button 12 may be locked by a shift button 26 against actuation so that the apparatus may safely be stored. Also, the gas supply is thus interrupted when the apparatus is put aside only temporarily. Locking the button 12 so as to prevent its actuation unless the shift button 26 or safety member is released, has the further advantage that children, especially, smaller children, cannot use the apparatus in a dangerous manner. Such a safety member would be arranged laterally of the housing and extend, for example, in the form of a spring biased bar into the operating shaft of the button 12. Such safety member would have to be actuated before the button 12 can be actuated and when the latter is returned in its starting or zero position the safety snaps back into position. Those safety devices as such are known in the art and hence not illustrated in detail. The safety member should be so arranged that the operation of the button 12 for an increased air supply is not affected by the safety feature.

Furthermore, the ignition fuel gas cartridge 6 could be of conventional construction and the cavity in the housing 1 which receives the cartridge 6 has dimensions geared to the conventionally available liquid gas cartridges. However, it is preferable to taper the walls of the cavity somewhat and to provide the cartridge 6 with a respective conical taper to facilitate its insertion and replacement. Further, the cartridge 6 could have a concave bottom to increase its pressure holding strength. In an alternative embodiment the cartridge 6 could be replaced by an adapter which is connected to a hose extending through the closure cap 5. The other end of the hose would be connectable to a conventional large supply container of liquid gas. Preferably the hose would be operatively connected to the closure cap 5 so as to relieve the hose from longitudinal tension or pulling forces.

Although the invention has been described with reference to specific example embodiments, it will be appreciated, that it is intended to cover all modifications and equivalents within the scope of the appended claims.

What is claimed is:

1. An apparatus for igniting and fanning a fire, comprising hollow housing means, fuel gas nozzle means in said hollow housing means, battery operated fan means in said hollow housing means, ignition means arranged to ignite fuel gas emerging from said fuel gas nozzle means, manual control means arranged in said hollow housing means and operatively connected to said ignition means, and to said fan means for activating the just mentioned components for a predetermined cooperation wherein said ignition means comprise piezoelectric crystal means (11) located substantially centrally in said housing and operable through force applying means responsive to said control means, said manual control means including gas closure valve means (9) operatively interposed in the gas supply line (22) between said fuel gas nozzle means (8) and a gas supply source (6), said manual control means further including two position switch means (10) operatively interposed between an electric motor of said fan means and a source of power (7) for said fan means, said manual control means further including a mechanical actuating member (12) operatively connected to said piezo-electric crystal means (11), to said valve means (9), and to said two position switch means (10), said apparatus further comprising mechanical air intake means (4) for adjusting the air supply to said battery operated fan means (3).

2. The apparatus of claim 1, wherein said control means first provide for a fuel supply to said nozzle means, then provide for an ignition spark to said nozzle means, and then provide for the operation of said fan means.

3. The apparatus of claim 2, wherein said control means provide a low fan operation substantially simultaneously with said ignition spark.

4. The apparatus of claim 1, wherein said ignition means comprise piezo-electric means, conductor means connected to said piezo-electric means and forming a spark gap with said fuel gas nozzle means, said control means comprising a mechanical connection to said piezo-electric means for applying a spark producing force to said piezo-electric means.

5. The apparatus of claim 4, wherein said housing means comprise a pipe extension wherein said nozzle means and said conductor means are operatively located.

6. The apparatus of claim 5, wherein said pipe extension has an open end, said ignition means being operatively held in said pipe extension adjacent said open end, wherein said fuel gas nozzle means are also located in said pipe means for cooperation with said ignition means, a first cavity in said housing means for holding an electrical power source, a second cavity in said housing means for holding fuel gas supply means, conduit means operatively connecting said fuel gas supply means to said nozzle means through said control means, a third cavity in said housing means, said fan means being located in said third cavity, said control means operatively connecting said fan means to said electric power source.

7. The apparatus of claim 1, wherein said housing means comprise a pipe extension having a shaped tip wherein said nozzle means are located, said tip including a flattened funnel shaped guide means for enhancing the mixing of air with the combustion flame, said guide means also preventing the exit of the flame out of said tip.

8. The apparatus of claim 1, further comprising pipe section means operatively connected to said housing means forming a handle, said battery operated fan means being arranged in said housing means adjacent to the interface between the pipe section and the housing, said fan means including electric motor means and a radial blower, said housing means further comprising a closure cap for closing a cavity adapted to receive a liquid gas cartridge and a further cavity adapted to receive electrical dry cells.

9. The apparatus of claim 1, wherein said housing means comprise air access port means operatively located for cooperation with said battery operated fan means, and means for varying the opening area of said air access port means, said varying means being operatively connected to said control means.

10. The apparatus of claim 1, wherein said control means comprise a single pressure-shifting button for actuating said piezo-electric crystal element, said valve means, and said switch means in common.

11. The apparatus of claim 1, wherein said control means comprise individual actuating elements all of which are arranged in a common area for actuation by one hand.

12. The apparatus of claim 1, wherein said control means for operating said valve means comprise automatic reset means for closing the valve means and thus the gas supply when the respective control means are not actuated.

13. The apparatus of claim 1, wherein said reset means comprise a safety button which must be actuated simultaneously with the control means for the valve means.

14. The apparatus of claim 1, further comprising electrical adapter means for driving said battery operated fan means from a regular power supply outlet.

* * * * *